US005984644A

United States Patent [19]

Yu et al.

[11] Patent Number: 5,984,644

[45] Date of Patent: Nov. 16, 1999

[54] DUAL OUTPUT WINDOW WASHER PUMP FOR AN AUTOMOTIVE VEHICLE

[75] Inventors: Dequan Yu; Frances S. Marchand, both of Ann Arbor, Mich.

[73] Assignee: Ford Motor Company, Dearborn, Mich.

[21] Appl. No.: 08/991,583

[22] Filed: Dec. 16, 1997

[51] Int. Cl.[6] ..... F04B 49/03

[52] U.S. Cl. ..... 417/302; 417/280; 417/423.1; 417/424.1

[58] Field of Search ..... 417/423.1, 424.1, 417/302, 380

[56] References Cited

U.S. PATENT DOCUMENTS

| | | | |
|---|---|---|---|
| 3,789,864 | 2/1974 | Cowan et al. . | |
| 3,807,426 | 4/1974 | Henes . | |
| 4,331,295 | 5/1982 | Warihashi . | |
| 4,600,361 | 7/1986 | Bianco . | |
| 4,653,977 | 3/1987 | Fries . | |
| 4,728,260 | 3/1988 | Ishii . | |
| 4,838,488 | 6/1989 | Heier et al. | 239/284.1 |
| 4,874,298 | 10/1989 | Mainardi et al. | 417/315 |
| 4,900,235 | 2/1990 | Perkins et al. | 417/315 |
| 4,919,591 | 4/1990 | Kamimura et al. | 415/152.1 |
| 5,344,293 | 9/1994 | Mota et al. . | |

FOREIGN PATENT DOCUMENTS

| | | |
|---|---|---|
| 0 271 318 | 2/1987 | European Pat. Off. . |
| 1142593 | 8/1956 | France . |
| 1049066 | 9/1957 | France . |
| 86 20 253 | 10/1987 | Germany . |
| 44 44 890 | 7/1996 | Germany . |
| 2186 325 | 12/1987 | United Kingdom . |

*Primary Examiner*—Timothy S. Thorpe
*Assistant Examiner*—Ehud Gartenberg
*Attorney, Agent, or Firm*—David B. Kelley

[57] ABSTRACT

A dual outlet washer pump for an automotive vehicle to alternately supply a stream of washer fluid to separate locations has a valve element with a frame portion surrounding a flat, flexible membrane mounted in vertically plainer fashion in a discharge section, which is movable from a center position unobstructing either of a pair of discharge ports to a first position in which fluid flow from a pumping chamber enters a first discharge side of the discharge section to directly impact a first side of the membrane causing flexure thereof away from the first discharge port to fluid flow there through and can currently causes contact of a second side of the membrane within an inner, lateral side of the discharge section adjacent the second discharge port to block fluid flow there through, the membrane opening the second discharge port and closing the first discharge port in the like manner when an impeller pump is rotated in a counter direction.

14 Claims, 3 Drawing Sheets

DUAL OUTPUT WINDOW WASHER PUMP FOR AN AUTOMOTIVE VEHICLE

FIELD OF THE INVENTION

The present invention relates to automotive windshield washer pumps in general, and more specifically to dual output window washer pumps.

BACKGROUND OF THE INVENTION

There is an increasing desire to provide automotive vehicles with both a windshield washer and a rear window washer, particularly in vans and sport utility vehicles having a generally vertical rear window. With this trend comes the design challenge of providing an economical means for supplying both rear and forward windows with washer fluid. In the past, separate washer pumps have been used to provide the necessary fluid. However, such a design is uneconomical due to duplication of components providing the same function. While it is known in the art to provide a dual output washer pump to obviate the economic drawbacks of separate pumps, current designs have not sufficiently solved the technical problem of generating two separate fluid flows from a single washer pump due to complexity, lack of function, or both.

One such design is shown in U.S. Pat. No. 4,600,361 (Bianco), which discloses a dual outlet washer pump having a horizontally positioned shutter means for separating and sealing two manifold chambers, and two separate communication conduits 21, 22 extending tangentially from an impeller housing and opening at either manifold chamber. This design is not only complex, requiring separate communication conduits and a hermetic seal between separate manifold chambers, but also lacks functionally due to the tortuous fluid path from the impeller housing, through the communication conduits, vertically upward or downward into a manifold chamber, and a 90° turn into a delivery manifold. Such a path results in pressure losses and adversely affects performance reliability. In addition, only half of the fluid flow from the impeller is channeled into a communication conduit due to the horizontal positioning of the manifold chamber, thus increasing energy requirements for the motor of the pump.

Another dual output pump, shown in French Patent 1,142,593, reveals various embodiments for a flow selector to alternately block one or the other of an outlet from the pump. Some embodiments show a shutter 7 which pivots and thus requires more complex construction, while another embodiment shows a flow selector made of a deformable material which has a separate bowl 11 held at the periphery to block an outlet. The flow selector of the latter embodiment is not only difficult to manufacture due to the addition of the bowl 11 onto the flexible material, but also may not meet the frequent open/shut requirements of the washer pump due to misalignment of the bowl 11 with the outlet.

There is thus needed a dual output washer pump which reliably provides an output stream of washer fluid, which has a simple design, which does not require excessive motor energy, and which is easy to assemble.

SUMMARY OF THE INVENTION

The present invention overcomes the deficiencies of the related art by providing a dual outlet washer pump for an automotive vehicle to alternately supply a stream of washer fluid between two outlets, the pump having a pump casing, a reversible motor mounted in the pump casing for rotating an impeller shaft, a pumping chamber in the pump casing, and an impeller mounted to the impeller shaft in the pumping chamber for bidirectional rotation. The pump also has a discharge section in direct fluid communication with the pumping chamber, and first and second discharge ports in a lateral surface of the discharge section for communicating the discharge section through first and second outlet conduits, respectively, to first and second outlets. A valve element, having a frame portion surrounding a substantially flat, flexible membrane, is mounted in vertically planar fashion in the discharge section so as to divide the discharge section into a first side and a second side. Fluid flow from the pumping chamber enters the first side of the discharge section when the impeller rotates in a first direction to directly impact a first side of the membrane causing flexure away from the first discharge port to allow fluid flow therethrough and concurrently causing contact of a second side of the membrane with an inner lateral side of the discharge section adjacent the second discharge port to block fluid flow therethrough. The membrane opens the second discharge port and closes the first discharge port in a like manner when the impeller is rotated in a counter direction. A valve bracket is mounted in the discharge section for slidably receiving the valve element in press-fit fashion therein.

An advantage of the present invention is a dual outlet washer pump which reduces flow losses by providing a direct path from the pumping chamber to a discharge section.

Another advantage of the present invention is a dual outlet washer pump which utilizes both a pressure differential across a valve element as well as pumped fluid impacting the valve element to ensure proper closing of a discharge port.

Still another advantage of the present invention is a dual outlet washer pump which reduces pumping motor energy requirements.

Yet still another advantage of the present invention is a dual outlet washer pump which is inexpensive to manufacture and easy to assemble.

A feature of the present invention is a dual outlet washer pump having a vertically planar valve element slidably fitted within a bracket in a discharge chamber in the pump housing.

BRIEF DESCRIPTION OF THE DRAWINGS

These and other objects, advantages, and features of the present invention will be apparent to those skilled in the art upon reading the following description with reference to the accompanying drawings, in which.

DETAILED DESCRIPTION OF THE PREFERRED EMBODIMENT

Figure 1:
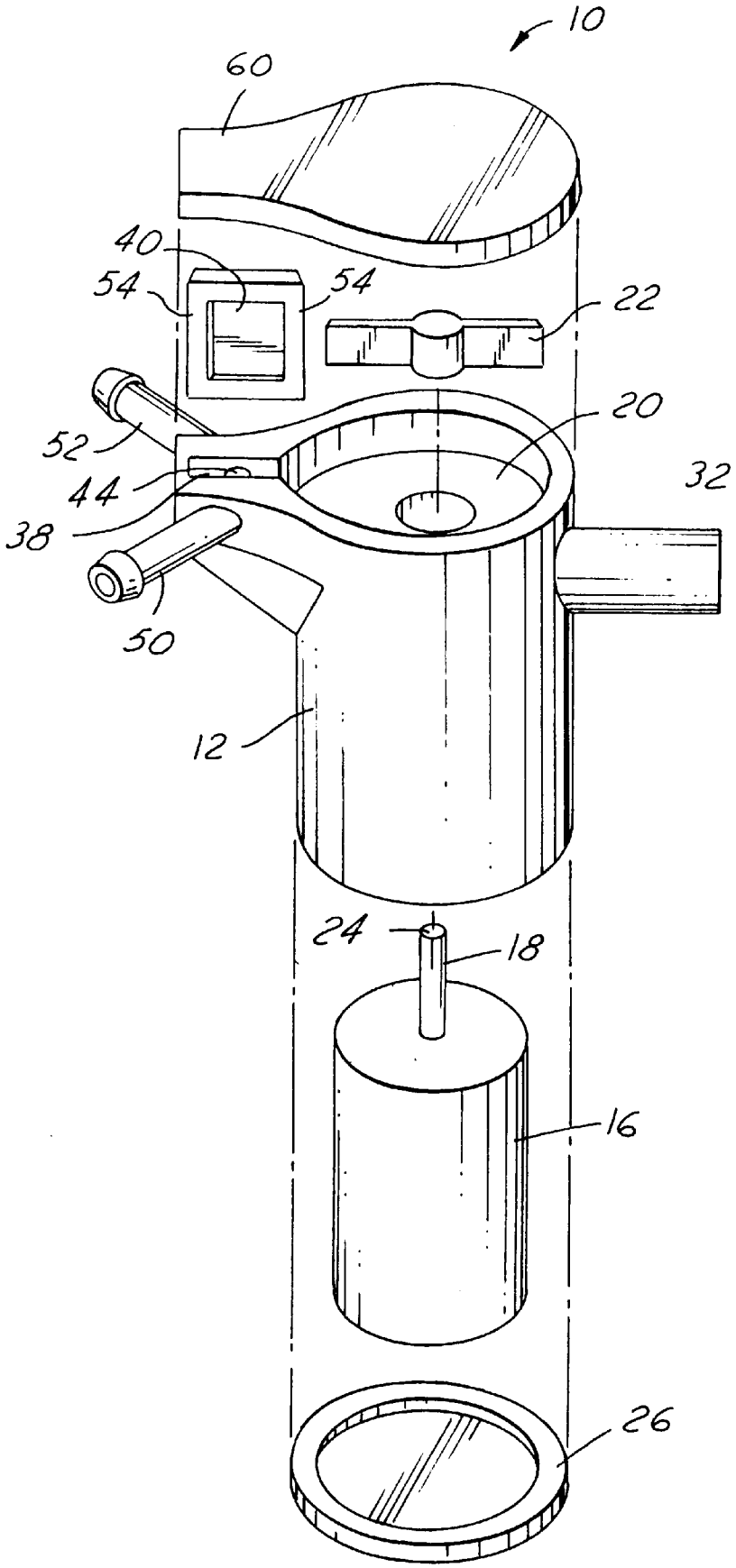
FIG. 1 is an exploded perspective view of a dual outlet washer pump according to one embodiment of the present invention.
Figure 2:
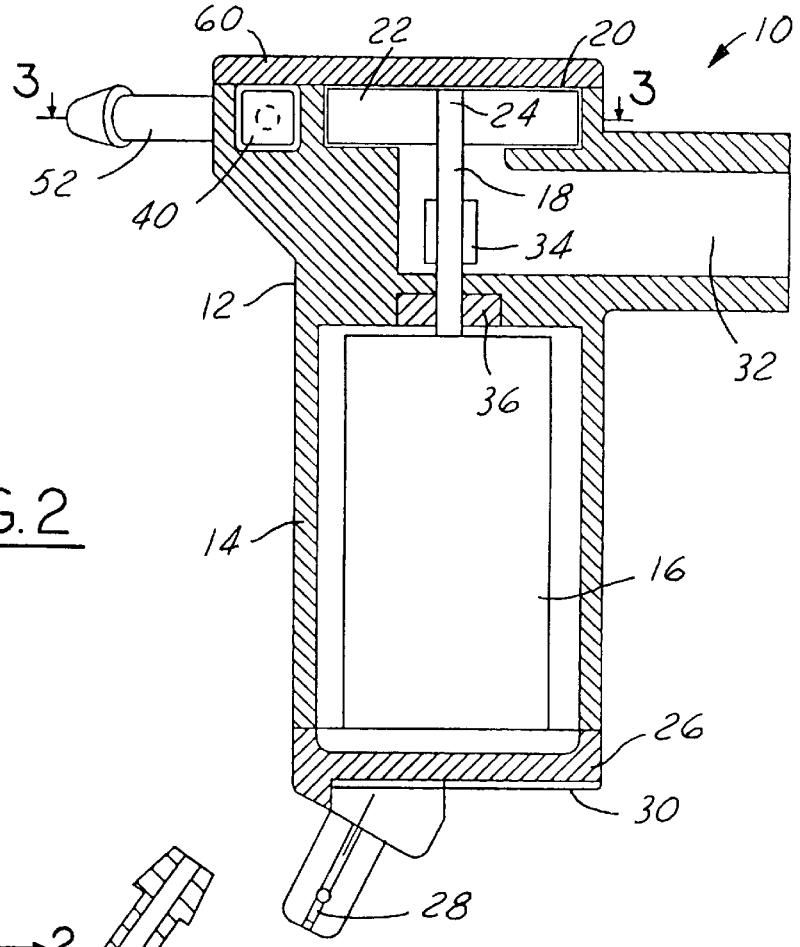
FIG. 2 is a side cross-sectional view of a dual outlet washer pump according to the present invention taken along line 2—2 of FIG. 3.

Turning now to the drawings, and in particular to FIGS. 1 and 2 thereof, a dual outlet washer pump 10 for an automotive vehicle (not shown) is shown in exploded and cross-sectional views. The pump 10 has a pump casing 12 with a lower section 14 in which is mounted a motor 16. The motor 16 is reversible, that is, it is capable of rotating an impeller shaft 18 extending therefrom in two directions, as further discussed below. In an upper portion of the casing 12 is an oval shaped pumping chamber 20 in which is mounted an impeller 22 on an impeller end 24 of the impeller shaft 18.

The motor 16 is held in place within the lower section 14 of the pump casing 12 by a bottom plate 26 (FIGS. 1 and 2), and a lead 28 extends from a lower surface 30 of the bottom plate 26 to supply electrical current to the motor 16 (FIG. 2). The pump casing 12 also has a washer fluid inlet 32 in fluid communication with the pumping chamber 20 for drawing fluid therethrough when the impeller 22 is rotated therein. A washer fluid hose (not shown) can be attached to the washer fluid inlet 32 and connected to a washer fluid reservoir (not shown) in a known manner. Roller bearings 34 facilitate rotary motion of the impeller 22, and a seal 36 prevents washer fluid from entering the lower section 14 of the pump casing 12 (FIG. 2).

Figure 3:
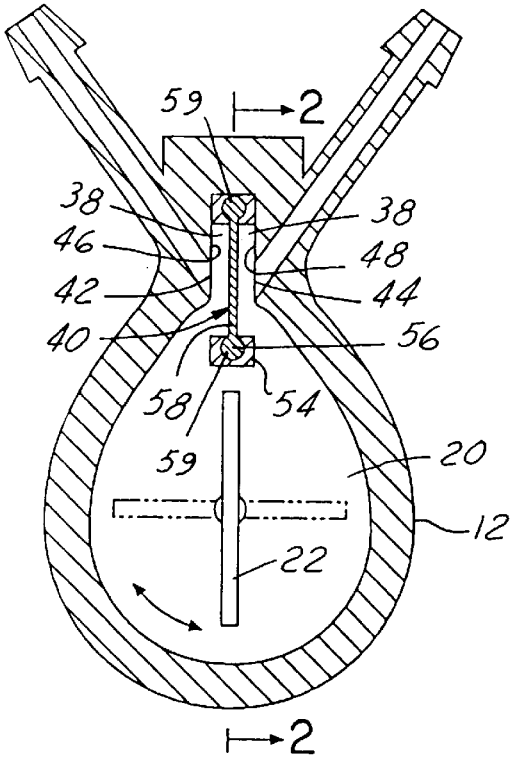
FIG. 3 is a cross-sectional view taken along line 3—3 of FIG. 2.

Referring to FIGS. 1 and 3, a discharge section 38 is seen to be in direct fluid communication with the pumping chamber 20, that is, there is no conduit through which fluid must travel before reaching the discharge section 38. Within the discharge section 38 is mounted a valve element 40 which, as further described below, alternately opens and closes a pair of discharge ports 42, 44 position in opposite lateral surfaces 46, 48, respectively, of the discharge section 38 (FIG. 3). The discharge ports 42, 44 communicate the discharge section 38 through outlet conduits 50, 52, respectively, to which fluid hoses (not shown) can be attached in a known manner to direct pumped washer fluid to desired locations in the vehicle, for example, to a front windshield and rear window.

Figure 4:
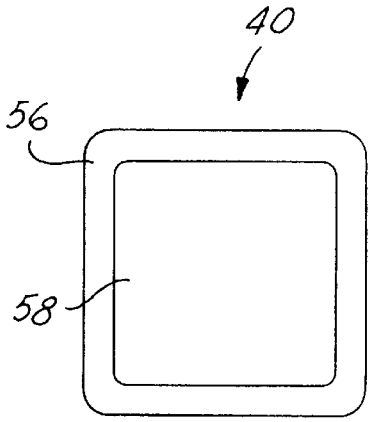
FIG. 4 is a side view of a valve element of the present invention shown removed from a bracket.
Figure 5A:
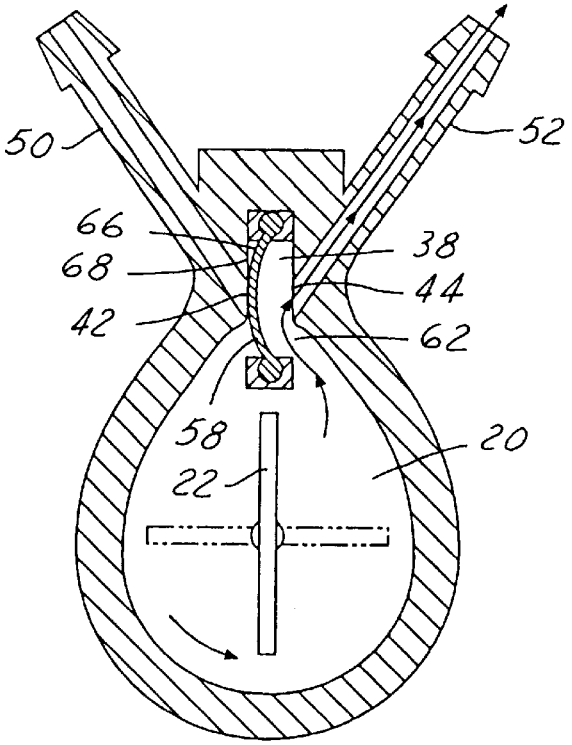
FIG. 5A is a cross-sectional view similar to FIG. 3 but showing a valve element deflected in a first position.
Figure 5B:
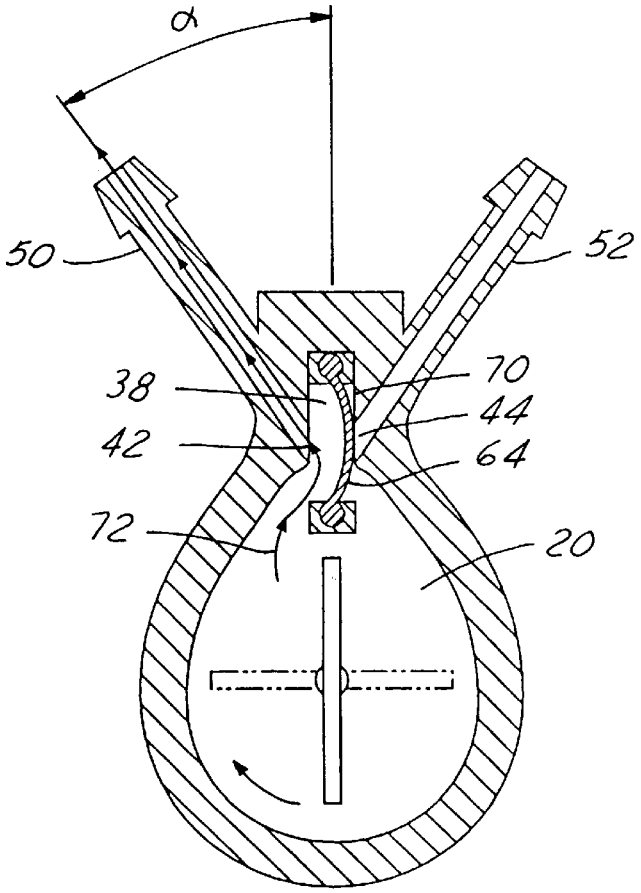
FIG. 5B is a cross-sectional view similar to FIG. 5A but showing the valve element deflected in an opposite position.

The valve element 40, which is held within the discharge section 38 by a pair of bracket ends 54 (FIGS. 1 and 3), preferably has a frame portion 56 surrounding a flat, flexible membrane 58 (FIG. 4). The valve element 40 is mounted in vertically planar fashion in the discharge chamber 38 in the bracket ends 54 which have a groove 59 for receiving the frame portion 56 therein (FIGS. 1 and 3). A pump cap 60 covers a top portion of the pump casing to close the pumping chamber 20 and the discharge section 38 (FIGS. 1 and 2). In operation, when washer fluid is desired on a window surface, an electric current is supplied through the lead 28 to a motor 16 (FIG. 2) to rotate the impeller 22 in a first direction, for example, a counter clock wise direction as shown in FIG. 5A. Washer fluid is drawn through the inlet 32, into the pumping chamber 20, and directly into the discharge section 38 (FIGS. 2 and 5A). Rotation of the impeller 22 causes a pressure difference across the valve element 40 causing deflection of the membrane 58 away from the discharge port 44 and toward the discharge port 42 (FIG. 5A), and the directional flow of washer fluid, indicated by arrows 62, directly impacts a first side 64 of the membrane 58 causing flexure thereof away from the discharge port 44 to allow fluid flow there through into the outlet conduit 52 (FIG. 5A). Concurrently, a second side 66 of the membrane 58 contacts an inner, lateral side 68 of the discharge section 38 adjacent the second discharge port 42 to block fluid flow there through (FIG. 5A). Washer fluid is thus prevented from flowing through the outlet conduit 50. When the direction of the impeller 22 rotation is reversed (FIG. 5B), fluid flow from the pumping chamber 22 enters a second discharge side of the discharge chamber 38 directly impacting the second side 66 of the membrane 58 causing flexure thereof away from the second discharge port 42 to allow fluid flow there through, and concurrently causes contact of the first membrane side 64 with an inner, lateral side 70 of the discharge section 38 adjacent the first discharge port 44 to block fluid flow there through. Washer fluid is thus directed into the outlet conduit 50, as indicated by arrows 72 and is blocked from flowing through the outlet conduit 52. As seen in FIG. 5B, the valve element 40 arrangement of the present invention in the pumping chamber 20 and discharge section 38 advantageously requires that fluid flow from the pumping chamber under go minimal path change during the pumping action, changing direction an angle $\alpha$ (FIG. 5B). Preferably, the angle alpha is between 45 degrees and 80 degrees.

Although the preferred embodiment of the present invention has been disclosed, various changes and modifications may be made without departing from the scope of the invention as set forth in the appended claims.

We claim:

1. A dual outlet washer pump for an automotive vehicle to alternately supply a stream of washer fluid between two outlets, the pump comprising:

a pump casing;

a reversible motor mounted in the pump casing for rotating an impeller shaft;

a pumping chamber in the pump casing;

an impeller mounted to the impeller shaft in the pumping chamber for rotation in a first direction and in a second direction;

a discharge section in direct fluid communication with the pumping chamber;

first and second discharge ports in a lateral surface of the discharge section for communicating the discharge section through first and second outlet conduits, respectively,; and a valve element, having a frame portion surrounding a substantially flat, flexible membrane, mounted in vertically planar fashion in the discharge section so as to divide the discharge section into a first side and a second side such that fluid flow from the pumping chamber enters the first side of the discharge section when the impeller rotates in a first direction to directly impact a first side of the membrane causing flexure thereof away from the first discharge port to allow fluid flow therethrough and concurrently causing contact of a second side of the membrane with an inner lateral side of the discharge section adjacent the second discharge port to block fluid flow therethrough, the membrane opening the second discharge port and closing the first discharge port in a like manner when the impeller is rotated in a counter direction.

2. A washer pump according to claim 1 wherein the membrane is made of a thin, elastic material.

3. A washer pump according to claim 2 wherein the frame portion is made of a plastic material.

4. A washer pump according to claim 1 wherein the valve element is square shaped.

5. A dual outlet washer pump for an automotive vehicle to alternately supply a stream of washer fluid to separate locations, the pump comprising:

a pump casing;

a reversible motor mounted in the pump casing for rotating an impeller shaft;

a pumping chamber in the pump casing;

an impeller mounted to the impeller shaft in the pumping chamber for rotation in a first direction and in a second direction;

a discharge section in direct fluid communication with the pumping chamber;

first and second discharge ports in a lateral surface of the discharge section for communicating the discharge section through first and second outlet conduits, respectively, to first and second outlets;

a valve element having a frame portion surrounding a flat, flexible membrane mounted in vertically planar fashion in the discharge section and movable from a center position unobstructing either of the discharge ports to a first position in which fluid flow from the pumping chamber entering a first discharge side of the discharge section directly impacts a first side of the membrane causing flexure thereof away from the first discharge port to allow fluid flow therethrough and concurrently causing contact of a second side of the membrane with an inner lateral side of the discharge section adjacent the second discharge port to block fluid flow therethrough, and to a second position in which fluid flow from the pumping chamber entering a second discharge side of the discharge section directly impacts a second side of the membrane causing flexure thereof away from the second discharge port to allow fluid flow therethrough and concurrently causing contact of a first membrane side of the membrane with an inner lateral side of the discharge section adjacent the first discharge port to block fluid flow therethrough; and a valve bracket mounted in the discharge section for slidably receiving the valve element in press-fit fashion therein.

6. A washer pump according to claim 5 wherein the valve bracket comprises a pair of bracket mounts, each of the pair of bracket mounts having a groove for receiving the frame portion of the valve element therein.

7. A washer pump according to claim 6 wherein the membrane is made of a thin, elastic material.

8. A washer pump according to claim 7 wherein the frame portion is made of a plastic material.

9. A washer pump according to claim 8 wherein the valve element is square shaped.

10. A washer pump for an automotive vehicle, comprising:

a pump casing;

a reversible motor mounted in the pump casing for rotating an impeller shaft;

a pumping chamber in the pump casing;

an impeller mounted to the impeller shaft in the pumping chamber for bidirectional rotation therein;

a discharge section in direct fluid communication with the pumping chamber;

first and second discharge ports communicating the discharge section through first and second outlet conduits, respectively; and a valve element vertically mounted in the discharge section for alternately opening and closing the first and second discharge ports in response to a pressure differential across the valve element created by the directional rotation of the impeller, the valve element having a frame portion surrounding a substantially flat, flexible membrane, the membrane contacting an inner lateral surface of the discharge section to close one or the other of the first and second discharge ports.

11. A washer pump according to claim 10 including a valve bracket mounted in the discharge section for slidably receiving the valve element in press-fit fashion therein, the valve bracket comprising a pair of bracket mounts, each of the pair of bracket mounts having a groove for receiving the frame portion of the valve element therein.

12. A washer pump according to claim 1 wherein the first and second outlet conduits are offset an angle alpha on opposing sides of a plane defined by the valve element, by an angle alpha of between approximately 45° to 60°.

13. A washer pump according to claim 5 wherein the first and second outlet conduits are offset an angle alpha on opposing sides of a plane defined by the valve element, by an angle alpha of between approximately 45° to 60°.

14. A washer pump according to claim 11 wherein the first and second outlet conduits are offset an angle alpha on opposing sides of a plane defined by the valve element, by an angle alpha of between approximately 45° to 60°.

* * * * *